US008313125B2

(12) United States Patent
Giorgetti et al.

(10) Patent No.: US 8,313,125 B2
(45) Date of Patent: Nov. 20, 2012

(54) COUPLING ARRANGEMENT AND CONNECTION ASSEMBLY

(75) Inventors: Edoardo Giorgetti, Rosignano Marittimo (IT); Massimo Latini, Empoli (IT); Daniel Marc, Leghorn (IT); Giandomenico Serra, Pisa (IT)

(73) Assignee: Continental Automotive GmbH, Hannover (DE)

( * ) Notice: Subject to any disclaimer, the term of this patent is extended or adjusted under 35 U.S.C. 154(b) by 220 days.

(21) Appl. No.: 12/354,962

(22) Filed: Jan. 16, 2009

(65) Prior Publication Data

US 2009/0184512 A1 Jul. 23, 2009

(30) Foreign Application Priority Data

Jan. 23, 2008 (EP) ..... 08001220

(51) Int. Cl.
*F02M 61/14* (2006.01)

(52) U.S. Cl. ..... 285/305; 123/470

(58) Field of Classification Search ..... 285/305; 123/470

See application file for complete search history.

(56) References Cited

U.S. PATENT DOCUMENTS

| | | | | | |
|---|---|---|---|---|---|
| 4,307,693 | A | * | 12/1981 | Glockler et al. | 123/470 |
| 4,475,516 | A | * | 10/1984 | Atkins et al. | 285/305 |
| 4,561,682 | A | * | 12/1985 | Tisserat | 285/305 |
| 5,058,554 | A | * | 10/1991 | Takeda et al. | 285/305 |
| 5,070,844 | A | * | 12/1991 | Daly | 285/305 |
| 5,092,300 | A | * | 3/1992 | Imoehl et al. | 285/305 |
| 5,146,896 | A | * | 9/1992 | Imoehl et al. | 285/305 |
| 5,167,213 | A | * | 12/1992 | Bassler et al. | 285/305 |
| 5,390,638 | A | * | 2/1995 | Hornby et al. | 285/305 |
| 5,405,175 | A | * | 4/1995 | Bonnah et al. | 285/305 |
| 5,893,351 | A | * | 4/1999 | Akutagawa et al. | 285/305 |
| 5,964,483 | A | * | 10/1999 | Long et al. | 285/305 |
| 5,970,953 | A | * | 10/1999 | Lorraine et al. | 285/305 |
| 5,979,411 | A | * | 11/1999 | Ricco | 123/469 |
| 6,019,089 | A | * | 2/2000 | Taylor et al. | 285/305 |
| 6,053,149 | A | * | 4/2000 | Lorraine | 285/305 |
| 6,419,282 | B1 | * | 7/2002 | Hornby | 285/305 |
| 6,481,646 | B1 | * | 11/2002 | Hornby | 123/470 |
| 6,491,026 | B1 | * | 12/2002 | Andorfer | 123/470 |
| 6,607,149 | B2 | * | 8/2003 | Smith et al. | 285/305 |
| 6,681,458 | B2 | * | 1/2004 | Seymour | 285/305 |
| 6,682,100 | B2 | * | 1/2004 | Wood et al. | 285/305 |
| 6,830,037 | B1 | | 12/2004 | Braun et al. | 123/470 |
| 6,869,110 | B2 | * | 3/2005 | Okada et al. | 285/319 |
| 7,029,036 | B2 | * | 4/2006 | Andre | 285/319 |
| 7,467,618 | B2 | * | 12/2008 | Zdroik et al. | 123/470 |

(Continued)

FOREIGN PATENT DOCUMENTS

DE 3428597 A1 2/1986

(Continued)

*Primary Examiner* — David E Bochna
(74) *Attorney, Agent, or Firm* — King & Spalding L.L.P.

(57) ABSTRACT

A coupling arrangement (12) includes a housing (6), at least one locking element (14) designed to at least partly surround the housing (6) forming a first area of contact (18) with the housing (6) via a positive locking or frictional connection to limit rotational movement of the housing (6), and a connecting element (16). The connecting element (16), arranged at least partly circumferentially around the housing (6) and being cylindrical with a center axis (X), has at least one locking recess (20) designed to at least partly take in the respective locking element (14) to limit rotational movement of the connecting element (16) via positive locking. The housing (6), the locking element (14) and the connecting element (16) are designed and arranged such as to limit movement of the housing (6) relative to the connecting element (16) at least in one direction of the center axis (X).

7 Claims, 3 Drawing Sheets

U.S. PATENT DOCUMENTS

| | | | | |
|---|---|---|---|---|
| 7,556,022 | B1 * | 7/2009 | Doherty et al. | 123/470 |
| 7,856,962 | B2 * | 12/2010 | Harvey et al. | 123/470 |
| 8,087,398 | B2 * | 1/2012 | Harvey et al. | 123/470 |
| 2001/0035165 | A1 | 11/2001 | Satou | 123/470 |
| 2005/0116056 | A1 | 6/2005 | Hans et al. | 239/5 |

FOREIGN PATENT DOCUMENTS

| | | | |
|---|---|---|---|
| EP | 1 255 038 | B1 | 11/2002 |
| WO | 2004/015263 | A1 | 2/2004 |

* cited by examiner

COUPLING ARRANGEMENT AND CONNECTION ASSEMBLY

CROSS-REFERENCE TO RELATED APPLICATIONS

This application claims priority to EP Patent Application No. 08001220 filed Jan. 23, 2008, the contents of which is incorporated herein by reference in its entirety.

TECHNICAL FIELD

The invention relates to a coupling arrangement and a connection assembly for coupling a connection body to a connecting element. Such a coupling arrangement and also such a connection assembly may be used in a fluid injection system, in particular for an internal combustion engine.

BACKGROUND

EP1255038B1 discloses a fuel injection system for the direct injection of fuel into at least one combustion space of an internal combustion engine. The fuel injection system has at least one fuel injection valve for each combustion space. The fuel injection valve can be inserted in each case at an injection portion into an assigned receiving board formed on a cylinder head of the internal combustion engine. The injection valve is connected to the pipe via two notches, one between an adapter and a retaining element and another between the retaining element and a connecting element, which is connected to the pipe.

SUMMARY

According to various embodiments, a coupling arrangement and a connection assembly can be created which enable a proper flexible and simple coupling of a connection body to a connecting element.

According to an embodiment, a coupling arrangement may comprise a housing, at least one locking element designed to at least partly surround the housing forming a first area of contact with the housing via positive locking or frictional connection to limit rotational movement of the housing, and a connecting element arranged at least partly circumferentially the housing and being cylindrical having a center axis comprising at least one locking recess designed to at least partly take in the respective locking element to limit rotational movement of the connecting element via positive locking, wherein the housing, the locking element and the connecting element are designed and arranged such as to limit movement of the housing relative to the connecting element at least in one direction of the center axis.

According to a further embodiment, the housing may comprise a first locking part comprising a first protrusion designed to form a second area of contact for the locking element, and/or a first groove designed to at least partly take in the locking element. According to a further embodiment, the connecting element may comprise a second locking part comprising a second protrusion designed to form a third area of contact for the locking element, and/or a second groove designed to at least partly take in the locking element and arranged at least partly at the same plane, which is perpendicular to the center axis of the connecting element extending through an axial point of the center axis, at which the locking recess of the connecting element is at least partly arranged. According to a further embodiment, the locking element may be horseshoe-shaped.

According to another embodiment, a connection assembly for connecting an injector to a fluid supply may comprise a coupling arrangement as described above, wherein the housing forms part of the injector, and the connecting element, which is fixed to a pipe of the fluid supply, communicates with the pipe through a fluid recess at an axial end area of the connecting element.

BRIEF DESCRIPTION OF THE DRAWINGS

The invention is explained in the following with the help of schematic drawings.

These are as follows.

Elements with the same design or function that appear in the different illustrations are identified by the same reference characters.

DETAILED DESCRIPTION

Figure 1:
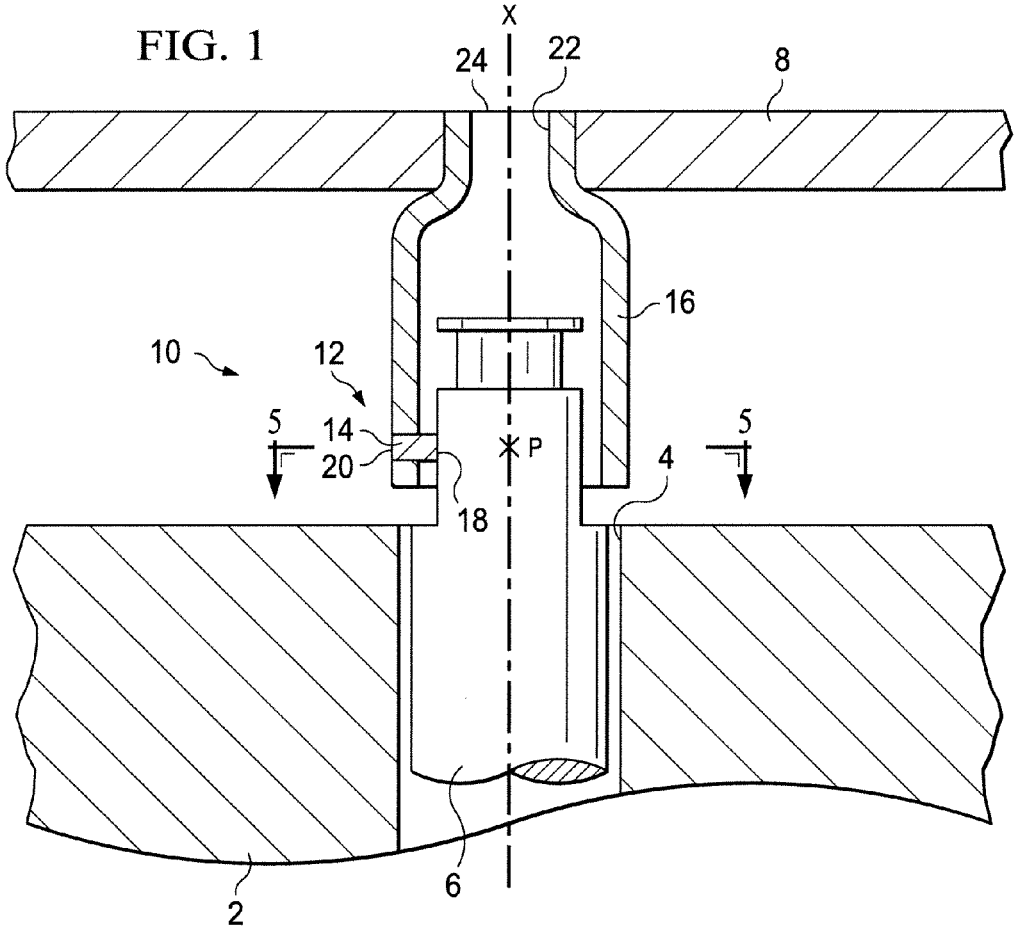
FIG. 1 a side cross-sectional view of an exemplary connection assembly with a first embodiment of a coupling arrangement, FIG. 2 another side cross-sectional view of the first embodiment of the coupling arrangement, taken perpendicular to the side view of FIG. 1, FIG. 3 a side cross-sectional view of a second embodiment of the coupling arrangement, FIG. 4 another side cross-sectional view of the second embodiment of the coupling arrangement, taken perpendicular to the side view of FIG. 1, FIG. 5 a top cross-sectional view of the first embodiment of the coupling arrangement, taken through the locking element, FIG. 6 a top cross-sectional view of the second embodiment of the coupling arrangement, taken through the locking element.

According to various embodiments, concerning a first aspect, there is provided a coupling arrangement with a housing, at least one locking element designed to at least partly surround the housing forming a first area of contact with the housing via positive locking or frictional connection to limit rotational movement of the housing, and a connecting element arranged at least partly circumferentially the housing and being cylindrical having a center axis. The connecting element comprises at least one locking recess designed to at least partly take in the respective locking element to limit rotational movement of the connecting element via positive locking. The housing, the locking element and the connecting element are designed and arranged such as to limit movement of the housing relative to the connecting element at least in one direction of the center axis.

In particular, the locking recess of the connecting element allows inserting the locking element at least partly on the inside of the connecting element. The arrangement of the connecting element at least partly circumferentially around the housing in particular yields to the formation of an overlapping area between the connecting element and the housing. By the locking recess and the overlapping area, it is enabled that the locking element at least partly surrounds the housing and forms the first area of contact with the housing via positive locking or frictional connection to limit rotational movement of the housing and at the same time the locking element is arranged within the locking recess of the connecting element. Thus, the connecting element with its locking recess combined with the locking element and the housing of any connection body such as an injector enable the coupling of the connection body to the connecting element via the locking element in a very fast and simple way. Furthermore, rotational movement of the connecting element and rotational movement of the housing of the connection body such as the injector can be limited. In addition, the coupling arrangement allows limiting movement of the housing relative to the connecting element at least in one direction of the center axis. Therefore, the connection body may be fixed via the locking element to a connecting element in a very fast and in a very simple way without the need for special tools. The connecting element with its locking recess combined with the locking element allows holding the connection body, for example an injector, from its top via the locking element in a very simple way.

In particular, by clipping the locking element to the housing, the locking element enables in an especially simple way holding the housing and therewith the connection body, for example the injector, from its top via the connecting element.

In an embodiment, the housing comprises a first locking part. The first locking part comprises a first protrusion designed to form a second area of contact for the locking element and/or a first groove designed to at least partly take in the locking element.

Thus, the locking element can be fixed to the housing in a simple way. Furthermore, a simple and low-cost manufacturing of the housing is achieved, which enables an especially firm arrangement of the locking element at the housing and therewith a coupling of the housing to the connecting element via the locking element.

In a further embodiment, the connecting element comprises a second locking part. The second locking part comprises a second protrusion designed to form a third area of contact for the locking element and/or a second groove designed to at least partly take in the locking element and arranged at least partly at the same plane, which is perpendicular to the center axis of the connecting element extending through an axial point of the center axis, at which the locking recess of the connecting element is at least partly arranged.

Thus, the locking element can be fixed to the connecting element in a simple way. Furthermore, a simple and low-cost manufacturing of the connecting element is achieved, which enables an especially firm arrangement of the locking element to the connecting element and therewith a coupling of the connecting element to the housing via the locking element.

In a further embodiment, the locking element is horseshoe-shaped.

By this, the coupling of the housing of the connection body to the connecting element via the locking element can be accomplished in an especially firm and simple way. Moreover, the horseshoe-shape of the locking element is aligned to the cylindrical-shape of the connecting element.

According to various embodiments, concerning a second aspect, there may be provided a connection assembly for connecting an injector to a fluid supply. The connection assembly comprises a coupling arrangement according to the first aspect, wherein the housing forms part of the injector, and the connecting element, which is fixed to a pipe of the fluid supply, and which communicates with the pipe through a fluid recess at an axial end area of the connecting element.

By this, the connection assembly enables holding the housing of the injector in its position respectively at least in one direction of the center axis of the connecting element via the locking element, and respectively a rotation of the housing of the injector around the center axis of the connecting element. Thus, the connecting element with its locking recess combined with the locking element and the housing of the injector enable the coupling of the injector to the connecting element via the locking element in a very fast and simple way. Therefore, the injector may be coupled to the fluid supply in a very fast and in a very simple way without the need for special tools. The connecting element with its locking recess combined with the locking element allows holding the injector from its top via the locking element in a very simple way. Furthermore, the connection assembly contributes to a proper coupling of the injector to the fluid supply, especially the axial orientation. This may contribute to the proper arrangement of the injector to an engine head.

An engine head 2 (FIG. 1) has a recess 4. A housing 6 of an injector is arranged in the recess 4 of the engine head 2. The housing 6 of the injector is coupled to a pipe 8 of a fluid supply by a connection assembly 10. The connection assembly 10 comprises a coupling arrangement 12.

The coupling arrangement 12 comprises the housing 6, a locking element 14 and a connecting element 16.

The locking element 14 partly surrounds the housing 6 and forms a first area of contact 18 with the housing 6 via positive locking to limit rotational movement of the housing 6. For example, rotational movement of the housing 6 may be disabled. In particular, the locking element 14 is horseshoe-shaped. By this, the coupling of the housing 6 of the injector to the connecting element 16 via the locking element 14 by positive locking can be accomplished in an especially firm and simple way. Moreover, the horseshoe-shape of the locking element 14 is aligned to the cylindrical-shape of the connecting element 16.

In a further embodiment, the locking element 14 and the housing 6 are coupled via frictional connection.

The connecting element 16 is arranged partly circumferentially the housing 6. The connecting element 16 is cylindrical having a center axis X. The connecting element 16 comprises one locking recess 20 designed to partly take in the locking element 14 to limit rotational movement of the connecting element 16 via positive locking. The housing 6, the locking element 14 and the connecting element 16 are designed and arranged such as to limit movement of the housing 6 relative to the connecting element 16 at least in one direction of the center axis X. In particular, movement of the housing 6 relative to the connecting element 16 in both directions of the center axis X is limited. For example, movement of the housing 6 relative to the connecting element 16 in both directions of the center axis X may be disabled.

In particular, the locking recess 20 of the connecting element 16 allows inserting the locking element 14 at least partly on the inside of the connecting element 16. The arrangement of the connecting element 16 at least partly circumferentially the housing 6 in particular yields to the formation of an overlapping area between the connecting element 16 and the housing 6. By the locking recess 20 and the overlapping area, it is enabled that the locking element 14 at least partly surrounds the housing 6 and forms the first area of contact 18 with the housing 6 via positive locking or frictional connection to limit rotational movement of the housing 6 and at the same time the locking element 14 is arranged within the locking recess 20 of the connecting element 16. Thus, the connecting element 16 with its locking recess 20 combined with the locking element 14 and the housing 6 of the injector enable the coupling of the injector to the connecting element 16 via the locking element 14 in a very fast and simple way. Furthermore, rotational movement of the connecting element 16 and rotational movement of the housing 6 of the injector can be limited at the same time. In addition, the coupling arrangement 12 allows limiting movement of the housing 6 relative to the connecting element 16 at least in one direction of the center axis X. For example, the coupling arrangement 12 allows disabling movement of the housing 6 relative to the connecting element 16 at least in one direction of the center axis X. Therefore, the injector may be fixed via the locking element 14 to the connecting element 16 in a very fast and in a very simple way without the need for special tools.

In the case of a fluid injection system, the connecting element 16 may be a fuel connection. The connecting element 16 communicates with the pipe 8 through a fluid recess 22 at an axial end area 24 of the connecting element 16.

The connection assembly 10 holds the housing 6 and therewith the injector in its position respectively at least in one direction of the center axis X of the connecting element 16 via the locking element 14, and respectively a rotation of the housing 6 of the injector around the center axis X of the connecting element 16. Therefore, the injector may be coupled to the fluid supply in a very fast and in a very simple way without the need for special tools. The connecting element 16 with its locking recess 20 combined with the locking element 14 allows holding the injector from its top via the locking element 14 in a very simple way. In particular, by clipping the locking element 14 to the housing 6, the locking element 14 enables in an especially simple way holding the housing 6 and therewith the injector from its top via the connecting element 16. Furthermore, the connection assembly 10 contributes to a proper coupling of the injector to the fluid supply, especially the axial orientation. This may contribute to the proper arrangement of the injector to the engine head 2.

Figure 2:
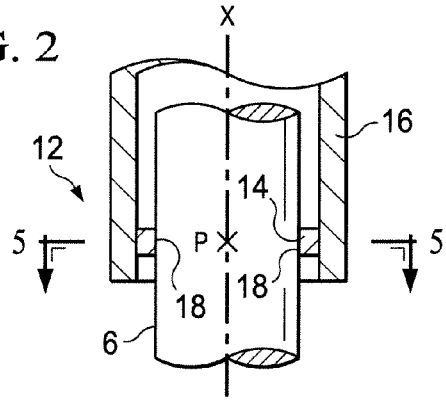

FIG. 2 shows the coupling arrangement 12 in a further view, which is perpendicular to the view of FIG. 1 regarding the center axis X of the connecting element 16. In particular, FIG. 2 in combination with FIG. 1 point out that the locking element 14 is horseshoe-shaped and therewith partly surrounds the housing 6. In particular, the locking element 14 is arranged at least partly at the same plane, which is perpendicular to the center axis X of the connecting element 16 extending through an axial point P of the center axis X, at which the locking recess 20 of the connecting element 16 is at least partly arranged.

Figure 5:
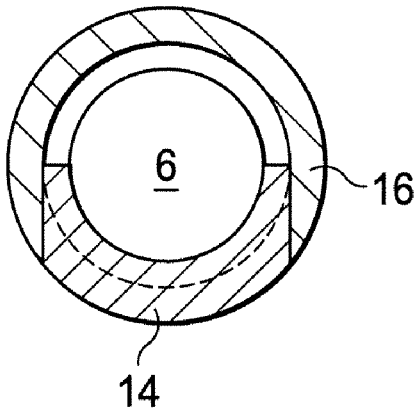

FIG. 5 shows a cross-sectional view of the coupling arrangement 12 shown in FIGS. 1 and 2, taken though cut line 5-5 shown in FIGS. 1 and 2.

For example, the locking element 14 and the locking recess 20 of the connecting element 16, which is designed to at least partly take in the locking element 14, are machined or milled or shaped in a cast process or by metal injection moulding. For instance, the locking element may be horseshoe-shaped or cup shaped. At the first area of contact 18 between the locking element 14 and the housing 6, the housing 6 may for example be machined by a milling operation, which flattens the area at the housing that is the area of engagement of the locking element 14 at the housing 6 in a special way. Furthermore, the locking element 14 has to fit exactly to surround at least partly the housing 14 and can for example be machined or stamped. By stamping the locking element 14, a low-cost manufacturing of the locking element 14 can be achieved. In particular, the locking element 14 and its direct contact with the housing 6 may limit the rotational movement of the housing 6 in a very fast and simple way.

In a further embodiment, the coupling arrangement 12 comprises two locking elements 14 and the connecting element 16 comprising two locking recesses 20. The two locking recesses 20 of the connecting element 16 may be arranged at different places circumferentially the connecting element 16. By this, the housing 6 of the injector may be coupled via the locking elements 14 to the connecting element 16 in an especially firm way.

When the housing 6 of the injector is assembled to the fluid supply, at first the housing 6 of the injector is prearranged to the connecting element 16 in such a way that the connecting element 16 is axially arranged at least partly circumferentially the housing 6 along the center axis X of the connecting element 16. Preferably, the housing 6 of the injector is prearranged to the connecting element 16 by putting it from the bottom up at least partly inside of the connecting element 16 that is starting in the direction of the center axis X of the connecting element 16 facing away from the fluid recess 22. Then, the locking element 14 is arranged to at least partly surround the housing 6 by inserting the locking element 14 through the locking recess 20 of the connecting element 16 at least partly on the inside of the connecting element 16. The locking element 14 and the housing 6 form the first area of contact 18 to limit rotational movement of the housing 6.

In this way, the locking element 14 enables the coupling of the housing 6 of the injector to the connecting element 16. This contributes to a proper coupling of the injector to the fluid supply in a very easy and fast way. Therefore, this contributes to low costs for manufacturing the connection assembly 10.

The invention is not restricted by the explained embodiments. For example, the locking recess 20 of the connecting element 16 comprises alternative shapes. Further, the locking element 14 may comprise alternative shapes.

Figure 3:
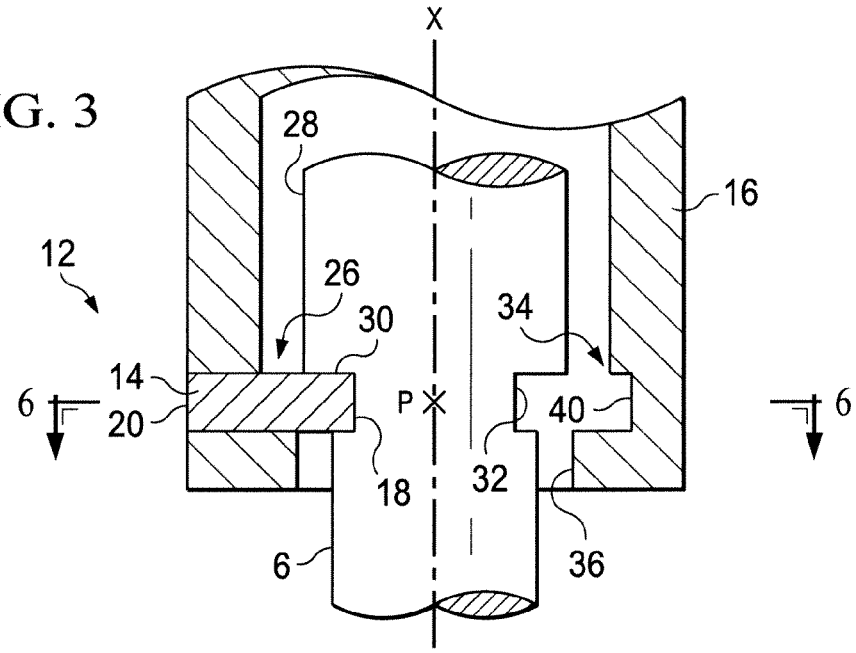

FIG. 3 shows a second embodiment of the coupling arrangement 12. The housing 6 comprises a first locking part 26. The first locking part 26 comprises a first protrusion 28 designed to form a second area of contact 30 for the locking element 14 and a first groove 32 designed to at least partly take in the locking element 14. Thus, the locking element 14 can be fixed to the housing 6 in a simple way. Furthermore, a simple and low-cost manufacturing of the housing 6 is achieved, which enables an especially firm arrangement of the locking element 14 to the housing 6 and therewith a coupling of the housing 6 to the connecting element 16 via the locking element 14.

Figure 4:
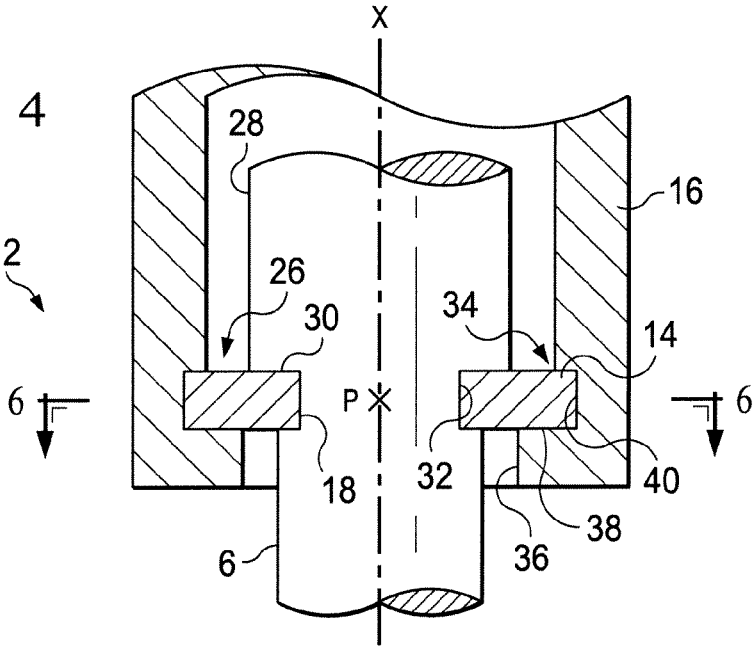
Figure 6:
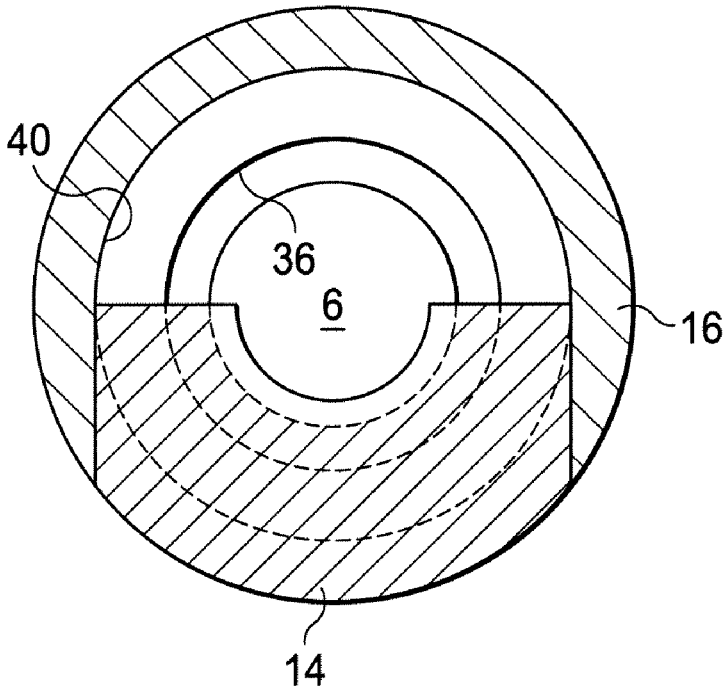

FIG. 6 shows a cross-sectional view of the second embodiment of the coupling arrangement 12 shown in FIGS. 3 and 4, taken through cut line 6-6 shown in FIGS. 3 and 4.

The connecting element 16 comprises a second locking part 34. The second locking part 34 comprises a second protrusion 36 designed to form a third area of contact 38 for the locking element 14 and a second groove 40 designed to at least partly take in the locking element 14 and arranged at least partly at the same plane, which is perpendicular to the center axis X of the connecting element 16 extending through an axial point P of the center axis X, at which the locking recess 20 of the connecting element 16 is at least partly arranged. Thus, the locking element 14 can be fixed to the connecting element 16 in a simple way. Furthermore, a simple and low-cost manufacturing of the connecting element 16 is achieved, which enables an especially firm arrangement of the locking element 14 to the connecting element 16 and therewith a coupling of the connecting element 16 to the housing 6 via the locking element 14.

FIG. 4 shows the second embodiment of the coupling arrangement 12 in a further view, which is perpendicular to the view of FIG. 3 regarding the center axis X of the connecting element 16. In particular, FIG. 4 in combination with FIG. 3 point out that the locking element 14 may be horseshoe-shaped and therewith partly surrounds the housing 6. In particular, the locking element 14 is arranged at least partly at the same plane, which is perpendicular to the center axis X of the connecting element 16 extending through an axial point P of the center axis X, at which the locking recess 20 of the connecting element 16 is at least partly arranged.

In a further embodiment, the first locking part 26 and the second locking part 34 may also only comprise the first protrusion 28 and the second protrusion 36, respectively.

In a further embodiment, the first locking part 26 and the second locking part 34 may only comprise the first groove 32 and the second groove 40, respectively.

In a further embodiment, the first locking part 26 may only comprise the first protrusion 28 and the second locking part 34 may comprise the second groove 40.

In a further embodiment, the first locking part 26 may only comprise the first groove 32 and the second locking part 34 may only comprise the second protrusion 36.

In a further embodiment, the first locking part 26 may only comprise the first groove 32 and the second locking part 34 may comprise the second protrusion 36 and the second groove 40.

In a further embodiment, the first locking part 26 may comprise the first groove 32 and the first protrusion 28 and the second locking part 34 may only comprise the second groove 40.

The first locking part 26 and the second locking part 34 are not restricted by the explained embodiments and may also be embodied in every possible combination of their respective detailed embodiments.

What is claimed is:

1. A connection assembly for connecting an injector to a fluid supply comprising:

a coupling arrangement comprising:

a housing, at least one locking element designed to at least partly surround the housing forming a first area of contact with the housing via positive locking or frictional connection to limit rotational movement of the housing, and a connecting element arranged at least partly circumferentially around the housing and being cylindrical with a center axis, the connecting element having a cylindrical shape and comprising at least one locking recess designed to at least partly take in the respective locking element to limit rotational movement of the connecting element via positive locking, wherein the at least one locking recess is sized and shaped for insertion of the at least one locking element through the locking recess in a radial direction perpendicular to an axial direction of the housing after the housing has been received in the connecting element in the axial direction of the housing, wherein the locking element is horseshoe-shaped and generally extends in a single plane, wherein the horseshoe-shaped locking element has an inner circumference and an outer circumference radially outward from the inner circumference, and wherein the horseshoe-shaped locking element includes a thicker central portion and thinner end portions, wherein a portion of the outer circumference of the locking element proximate the thicker central portion defines an outer surface that aligns with an outer surface of the cylindrical connecting element, wherein the housing, the locking element and the connecting element are designed and arranged such as to limit movement of the housing relative to the connecting element at least in one direction of the center axis, wherein the housing forms part of the injector, and the connecting element, which is fixed to a pipe of the fluid supply, communicates with the pipe through a fluid recess at an axial end area of the connecting element.

2. The connection assembly according to claim 1, wherein the housing comprises a first locking part comprising at least one of:

a first protrusion designed to form a second area of contact for the locking element, and a first groove designed to at least partly take in the locking element.

3. The connection assembly according to claim 2, wherein the connecting element comprises a second locking part comprising at least one of:

a second protrusion designed to form a third area of contact for the locking element, and a second groove designed to at least partly take in the locking element and arranged at least partly at the same plane, which is perpendicular to the center axis of the connecting element extending through an axial point of the center axis, at which the locking recess of the connecting element is at least partly arranged.

4. The connection assembly according to claim 1, wherein the outer surface of the thicker central portion is flush with the cylindrical shape of the connecting element.

5. A method for locking a coupling arrangement for a fuel injector having a housing and a fluid supply, comprising the steps of:

inserting the housing within a connecting element in the axial direction of the housing in such a way that the connecting element is axially arranged at least partly circumferentially around the housing;

with the housing inserted in the connecting element, inserting a horseshoe-shaped locking element in a radial direction perpendicular to the axial direction of the housing through a locking recess formed in the connecting element to at least partly surround the housing, wherein the horseshoe-shaped locking element has an inner circumference and an outer circumference radially outward from the inner circumference, wherein the inserted locking element and the housing form a first area of contact limiting rotational movement of the housing, and such that a portion of the outer circumference of the inserted locking element located at a central portion of the locking element aligns with a cylindrical surface of the connecting element.

6. The method according to claim 5, wherein the housing of the injector is pre-arranged with the connecting element by putting the housing from the bottom up at least partly inside of the connecting element starting in the direction of a center axis of the connecting element facing away from a fluid recess.

7. The method according to claim 5, wherein the outer surface of the thicker central portion is flush with the cylindrical shape of the connecting element.

* * * * *

UNITED STATES PATENT AND TRADEMARK OFFICE

CERTIFICATE OF CORRECTION

PATENT NO. : 8,313,125 B2
APPLICATION NO. : 12/354962
DATED : November 20, 2012
INVENTOR(S) : Edoardo Giorgetti It is certified that error appears in the above-identified patent and that said Letters Patent is hereby corrected as shown below:

Title Page, item (75) Inventors, "Leghorn (IT)" should read -- LIVORNO (IT) --.

Signed and Sealed this
Twelfth Day of February, 2013

Teresa Stanek Rea
*Acting Director of the United States Patent and Trademark Office*